US006276848B1

(12) United States Patent
Takizawa et al.

(10) Patent No.: US 6,276,848 B1
(45) **Date of Patent: *Aug. 21, 2001**

(54) THERMAL PRINTER HAVING INTEGRALLY FORMED PAPER GUIDE AND FRAME

(75) Inventors: Hiroshi Takizawa, Shiojiri; Manabu Shimizu, Matsumoto; Koji Yamada; Katsunari Kumagai, both of Okaya, all of (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/142,822

(22) PCT Filed: Jan. 14, 1998

(86) PCT No.: PCT/JP98/00148

§ 371 Date: Sep. 14, 1998

§ 102(e) Date: Sep. 14, 1998

(87) PCT Pub. No.: WO98/30396

PCT Pub. Date: Jul. 16, 1998

(30) Foreign Application Priority Data

Jan. 14, 1997 (JP) ..... 9-005012

(51) Int. Cl.[7] ..... B41J 2/32; B41J 13/14

(52) U.S. Cl. ..... 400/120.01; 400/694; 400/642; 400/645.5

(58) Field of Search ..... 400/120.01, 120.02, 400/120.03, 120.04, 120.05, 120.06, 120.07, 120.08, 120.09, 120.1, 120.11, 120.13, 120.14, 120.15, 120.16, 120.17, 120.18, 642, 643, 645, 645.4, 645.5, 647, 647.1, 630, 632, 694

(56) References Cited

U.S. PATENT DOCUMENTS

| | | | | |
|---|---|---|---|---|
| 4,425,047 | | 1/1984 | Narushima | 400/605 |
| 4,683,478 | * | 7/1987 | Suzaki et al. | 400/233 |
| 5,342,131 | * | 8/1994 | Nakajima et al. | 400/234 |
| 5,541,635 | * | 7/1996 | Wills et al. | 347/197 |
| 5,618,117 | * | 4/1997 | Yoshida et al. | 400/120.04 |
| 5,820,068 | * | 10/1998 | Hosomi et al. | 242/563 |
| 5,833,380 | * | 11/1998 | Hosomi et al. | 400/621 |
| 5,846,003 | * | 12/1998 | Mori et al. | 400/120.17 |
| 5,902,059 | * | 5/1999 | Asai et al. | 400/642 |
| 6,118,469 | * | 9/2000 | Hosomi | 347/222 |

FOREIGN PATENT DOCUMENTS

| | | | |
|---|---|---|---|
| 54-19007 | | 2/1979 | (JP) . |
| 57-177755 | | 11/1982 | (JP) . |
| 60-105573-A | * | 6/1985 | (JP) . |
| 61-219671-A | * | 9/1986 | (JP) . |
| 04-1658841-A | * | 5/1992 | (JP) . |
| 4-140175 | | 5/1992 | (JP) . |

* cited by examiner

*Primary Examiner*—John S. Hilten
*Assistant Examiner*—Leslie J. Grohusky
(74) *Attorney, Agent, or Firm*—Nixon & Vanderhye P.C.

(57) ABSTRACT

A thermal printer for a portable electronic device such as a receipt issuing machine is capable of increasing an angle at which thermal recording paper is wound on a platen roller while decreasing running load and without generating static electricity. The thermal printer includes a body frame formed from metal, a thermal head disposed on a bottom part of the body frame for printing paper and a platen roller for urging the paper against the thermal head. A paper guide for guiding the paper to a direction in which the paper is wound on the platen roller is integrally formed with the body frame. A bend-raise portion extending in a paper-width direction of the paper and contacting linearly to the paper while feeding is integrally formed at a part of the paper guide where the paper is inserted. The paper guide is formed in such a manner that it comes close to the platen roller with respect to the bottom of the body frame.

15 Claims, 6 Drawing Sheets

THERMAL PRINTER HAVING INTEGRALLY FORMED PAPER GUIDE AND FRAME

TECHNICAL FIELD

The present invention relates to a small-sized line thermal printer used for a portable electronic device such as a receipt issuing machine.

BACKGROUND ART

Heretofore, a small-sized line thermal printer is widely used for a portable electronic device such as a receipt issuing machine.

As this type of thermal printer is required to be readily portable, a small-sized, light one is desired.

Therefore, heretofore, a body frame is made of metal such as a thin steel plate and a paper guide made of plastic for guiding recording paper to a printing part between a platen roller and a thermal head is installed as disclosed, for example, in Unexamined Japanese Patent Application No. Hei. 4-140175.

In such a thermal printer, a platen roller 104 and a head support part 103 are secured to a body frame 102 made of plastic as shown in FIG. 6, for example. Predetermined printing is executed on thermal recording paper by attaching a thermal head 130 on the side of the platen roller 104 of the head support part 103 so that thermal recording paper is held between the thermal head and the platen roller and by pressing the thermal head 130 attached to the head support part 103 on the platen roller 104 by a torsion coil spring 107.

There is also another conventional thermal printer in which a body frame is formed integrally with a paper guide from plastic material such as polycarbonate.

However, in such conventional type thermal printers, there are the following problems:

That is, in the case of the above conventional type thermal printers, as the paper guide 121 is made of plastic material, a charge cannot be discharged from the paper guide if thermal recording paper 100 is electrified, and the thermal head 130 may be broken by a spark and others.

Further, as the paper guide 121 is also electrified, there is a problem that the thermal recording paper 100 cannot be guided to the vicinity of the thermal head 130 and the thermal recording paper is hard to insert.

As the platen roller 104 is arranged apart from the bottom of the printer in view of space for gears for driving the platen roller, the paper guide 121 cannot be formed as a part of the body frame 102. Therefore, as the paper guide 121 is made of another member, the number of parts is increased and as a result, the cost is increased.

Even if the paper guide 121 is formed as a part of the body frame 102, there is also a problem that it is difficult to increase an angle at which thermal recording paper 100 is wound on the platen roller 104 and precision in feeding paper is not satisfactory.

Furthermore, if the body frame is also made of plastic material as in the other conventional types, the frame must be formed relatively thick to enhance rigidity. As a result, miniaturization cannot be sufficiently achieved.

SUMMARY OF THE INVENTION

The present invention was made in view of the problems and difficulties accompanying the conventional thermal printers. Therefore, an object of the present invention is to provide a thermal printer capable of increasing an angle at which thermal recording paper is wound on a platen roller without generating static electricity.

Another object of the present invention is to provide a thermal printer that is small in size and light in weight, which requires the small numbers of parts and components.

A thermal printer according to the present invention includes a metallic body frame for supporting at least one of a thermal head and a platen roller for holding recording paper in a printing position and a paper guide for guiding the recording paper to the printing position. In the thermal printer of the invention, the paper guide at least in the vicinity of the printing position is integrated, meaning homogeneously formed so as to be a single part, with the body frame.

According to the above constitution, as the paper guide for guiding recording paper to the printing paper is integrated with the metallic body frame, static electricity is discharged via recording paper even if the recording paper is electrified and the paper guide is never electrified. As a result, as no spark is generated between the vicinity of a printing position of the paper guide and the thermal head, the paper guide can be arranged in the vicinity of the printing position and thermal recording paper can be readily and smoothly inserted.

In addition, as the paper guide is not made of plastic material in the case of the present invention, the thickness can be reduced, and as the paper guide is integrated with the body frame, the number of parts can be reduced and as a result, a small-sized, light and low-priced thermal printer can be obtained.

Also, in the case of the present invention, the paper guide in a position in which recording paper is inserted is integrated with the body frame, is bent upward approximately along the width of paper and is provided with a bend-raise portion on which recording paper is slid.

In this case, as static electricity generated on recording paper is discharged via the bend-raise portion by integrating the bend-raise portion which comes in contact with the recording paper with the frame, the carried recording paper can be prevented from being electrified, and any detrimental effect upon the thermal head by static electricity can be prevented.

As an angle at which recording paper is wound on the platen roller can be increased by the bend-raise portion and in addition, the area in which the paper guide and the recording paper are in contact is reduced by the bend-raise portion, a running load is not increased even if the recording paper is wet, the recording paper is smoothly run and high quality printing is enabled.

Further, in the case of the present invention, the paper guide is provided with a step relative to the bottom of the body frame along the direction of the width of recording paper so as to approach the platen roller.

According to the above constitution, the shape along the platen roller of the paper guide can be readily obtained without working so that the paper guide is large-sized, the bend-raise portion provided with desired height can be obtained and hereby, the paper guide high in rigidity and precision can be obtained.

DETAILED DESCRIPTION OF PREFERRED EMBODIMENTS

Referring to FIGS. 1 to 5, an embodiment for realizing a thermal printer according to the present invention will be described in detail below.

Figure 1:
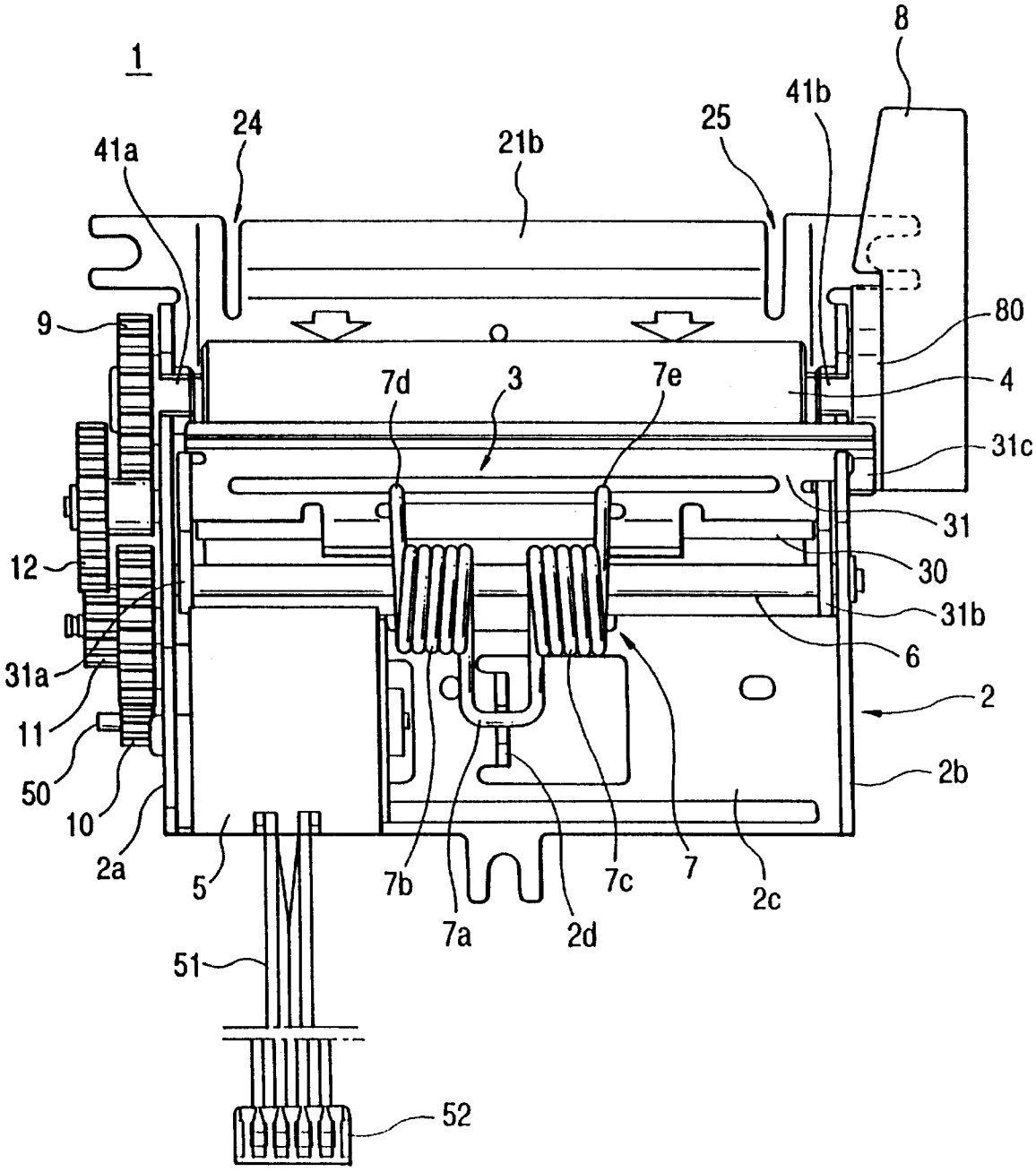
FIG. 1 is a plan showing the whole constitution of an embodiment of a thermal printer according to the present invention, is a side view showing the constitution of a printing part in the embodiment and shows a state in which a lever member is pushed down.
Figure 2:
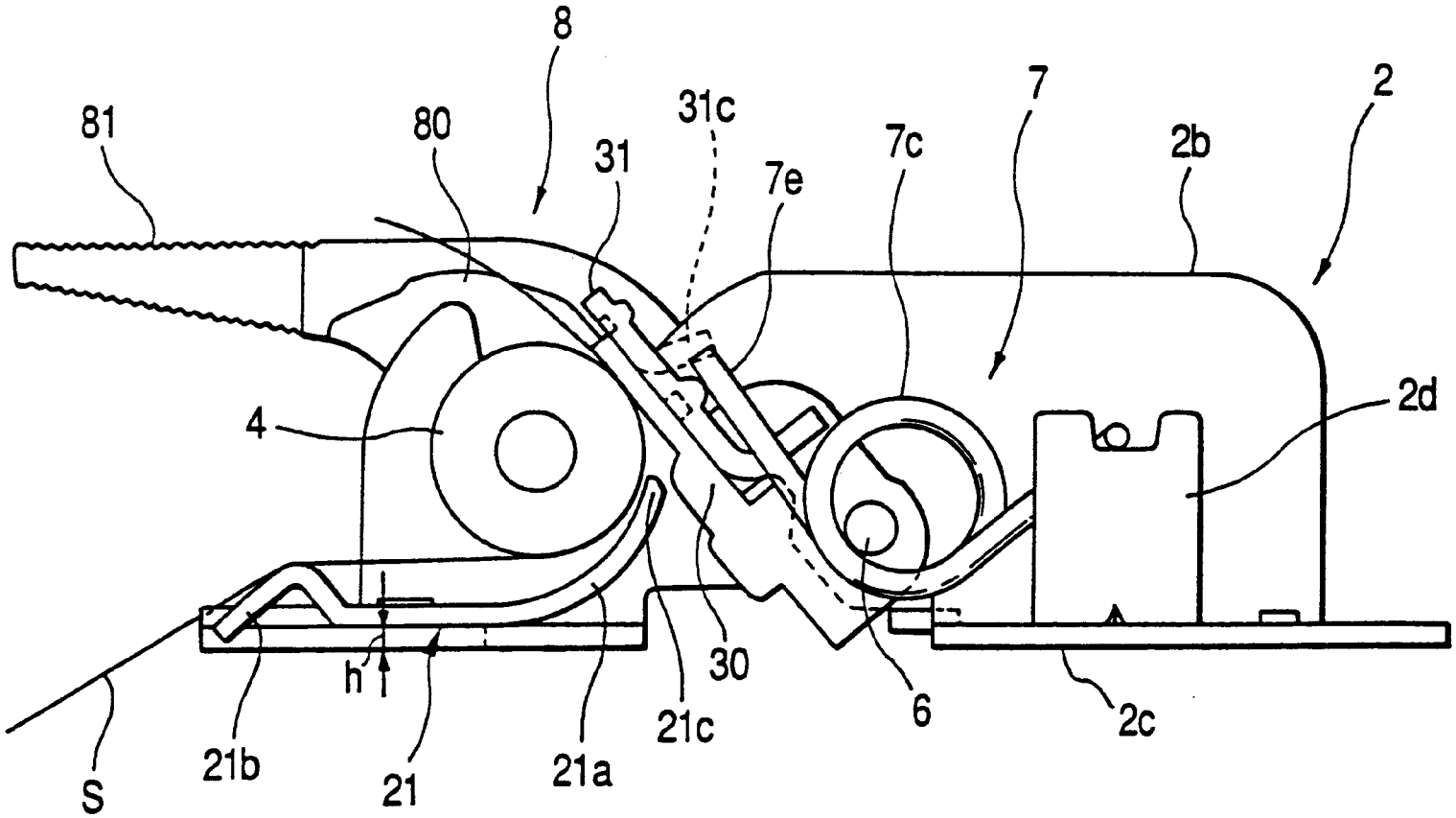
Figure 3:
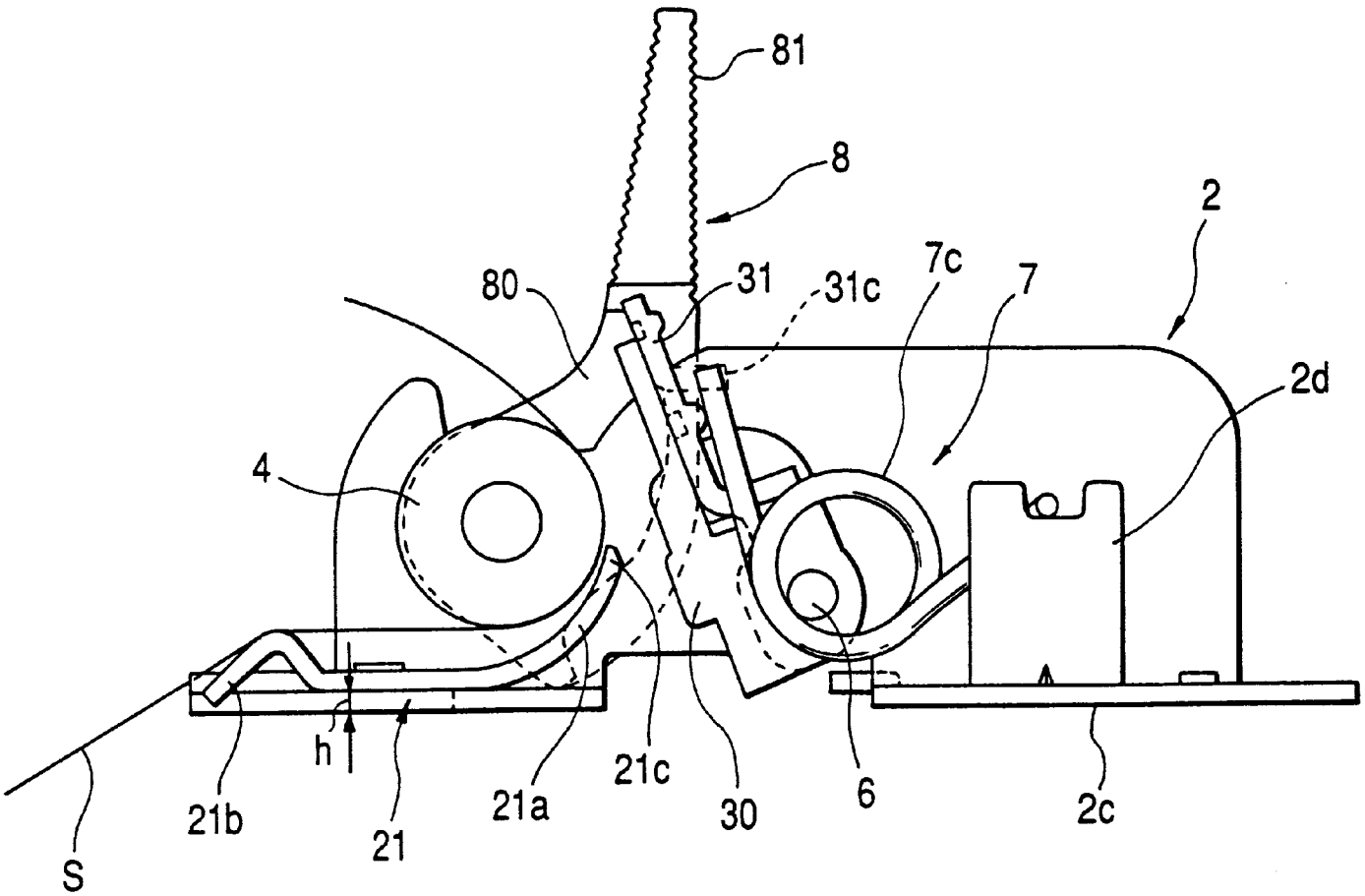
FIG. 3 is a side view showing the constitution of the printing part in the embodiment of the present invention.
Figure 4:
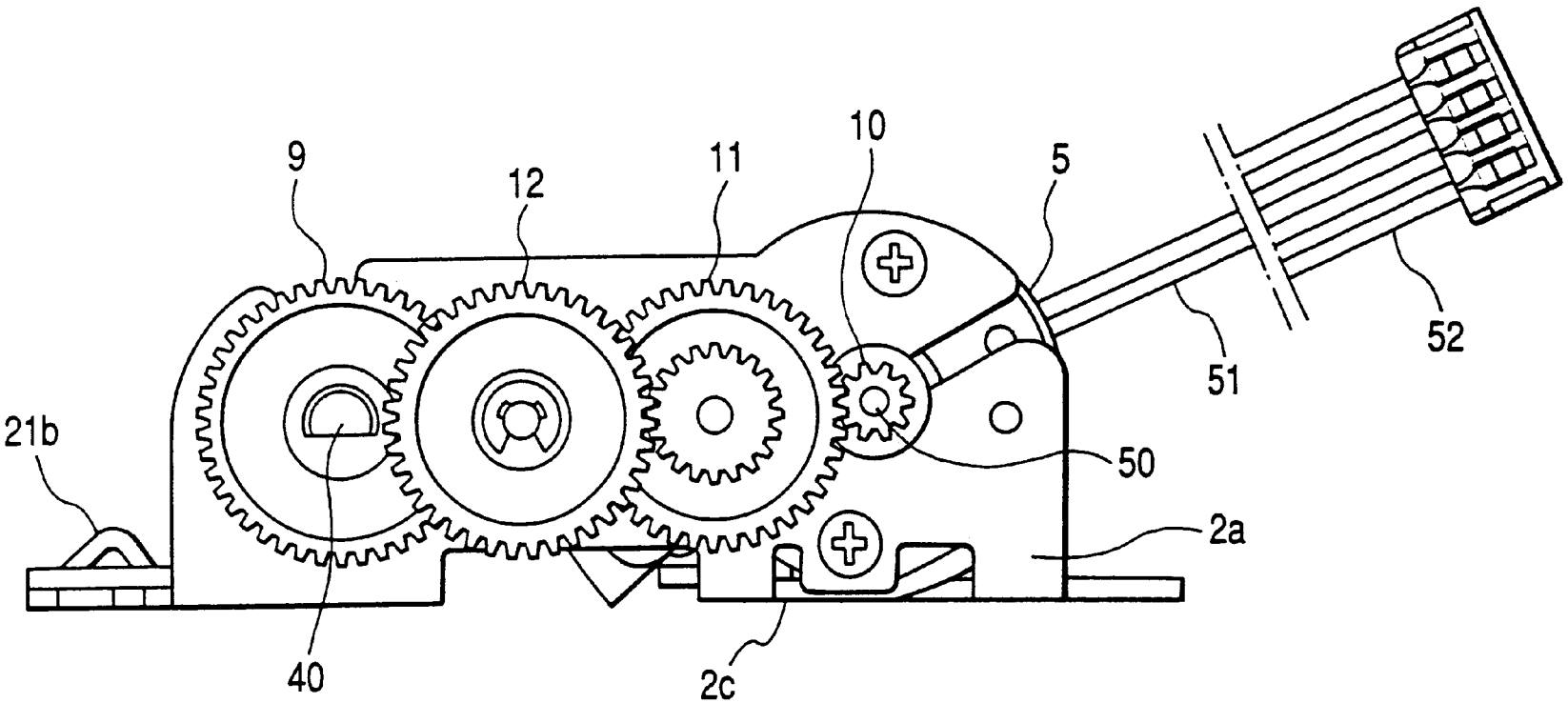
FIG. 4 is a side view showing the constitution of a driving part in the embodiment.
Figure 5:
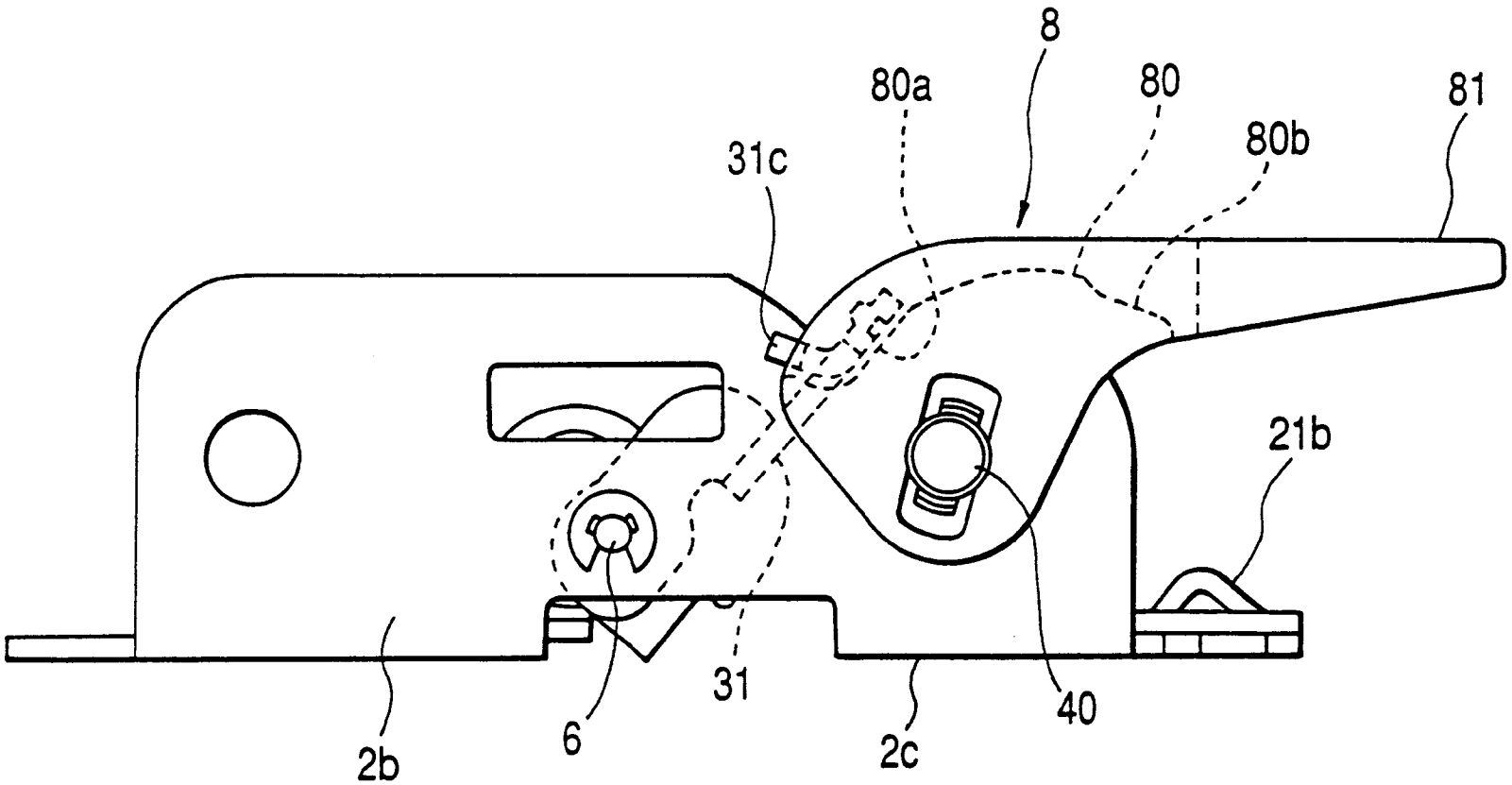
FIG. 5 is a side view showing the vicinity of the lever member in the embodiment.
Figure 6:
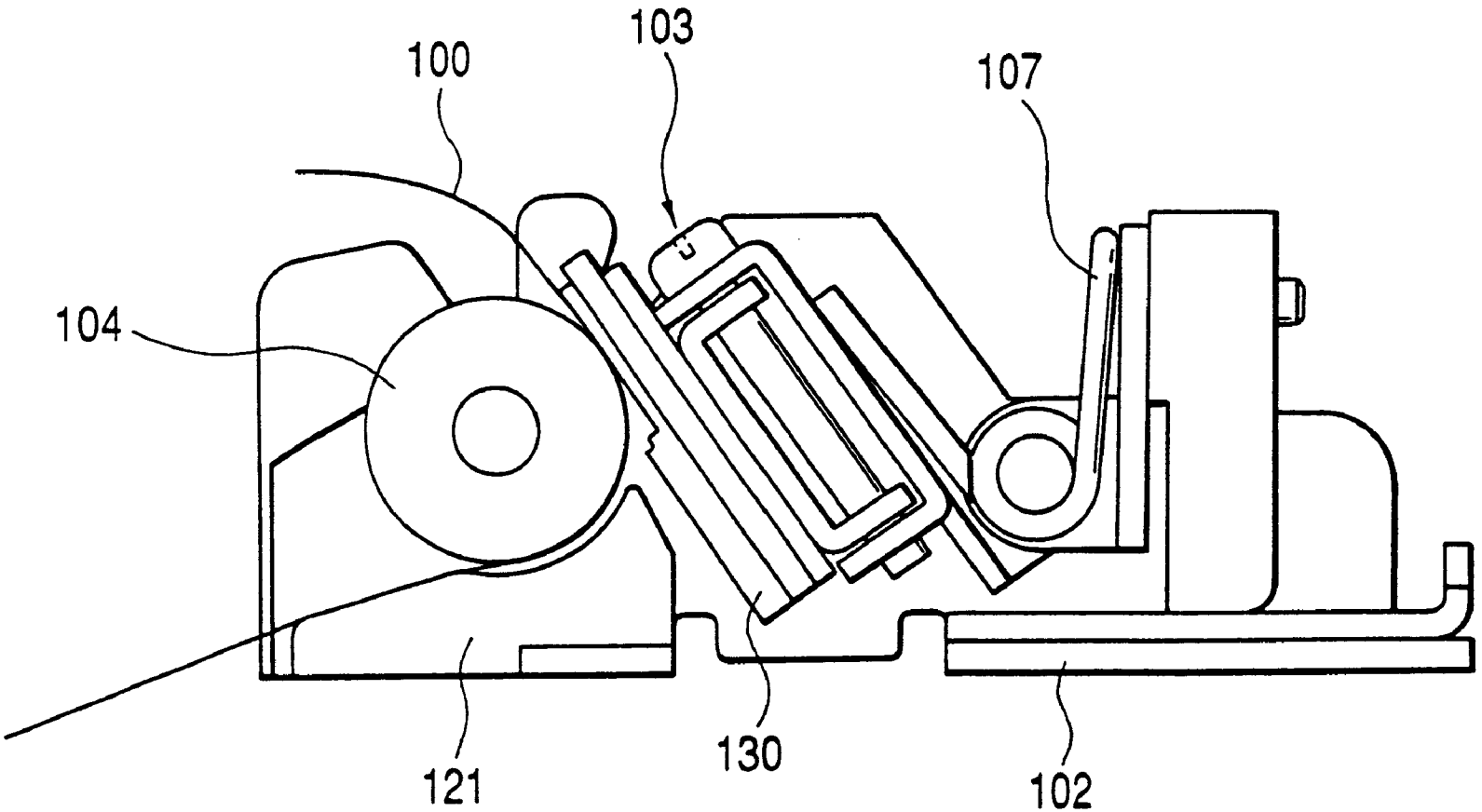
FIG. 6 (PRIOR ART)
FIG. 6 is a side view showing the constitution of a conventional type thermal printer.

FIG. 1 is a plan showing a thermal printer equivalent to this embodiment, FIG. 2 is a side view showing a printing part and shows a state in which a lever member is pushed down and a thermal head presses a platen roller, FIG. 3 is a side view showing the printing part and a state in which the lever member is pulled up and a thermal head is separated from a platen roller, FIG. 4 is a side view showing a driving part and FIG. 5 is a side view showing the vicinity of the lever member.

As shown in FIG. 1, a thermal printer 1 is provided with a body frame 2 made of metal such as cold-rolled steel (SPCC), and a printing part 3. A platen roller 4 and a driving motor 5 for driving the platen roller 4 are attached to the body frame 2.

The body frame 2 is formed by bending the bottom 2*c* and a pair of side walls 2*a* and 2*b* by sheet metal working. A paper guide 21 described later is formed on the rear side of the body frame 2. The width of each frame side wall 2*a* and 2*b* is set to a dimension slightly larger than the width of a paper roll described later.

The printing part 3 is constituted by the thermal head 30 and a fixing plate 31. A predetermined electrode is formed on the surface of the thermal head 30 and is connected to a circuit board (not shown). The thermal head 30 is fixed to a long flat fixing plate 31 made of metal such as a soft iron plate.

Arms 31*a* and 31*b* are bent at both ends of the fixing plate 31 so that each bent width is approximately equal to the inside width of the body frame 2. These arms 31*a* and 31*b* are attached to a supporting shaft 6 suspended in parallel with the platen roller 4 on both sides of the body frame 2 so that the arms can be turned freely. A torsion coil spring 7 required for the thermal head 30 to press the platen roller 4 is attached to the supporting shaft 6. In this case, as shown in FIG. 1, spring portions 7*b* and 7*c* are formed on both sides of a fitting portion 7*a* in the shape of approximately a letter C in the center of the torsion coil spring 7. The supporting shaft 6 is attached with it piercing the torsion coil spring 7. The arms 7*d* and 7*e* of the spring 7 press the fixing plate 31, and the fitting portion 7*a* is pressed by a supporting portion 2*d* formed from the bottom 2*c* of the body frame 2. With this arrangement, the thermal head 30 presses the platen roller 4 toward the bottom 2*c* from the top.

A protruded portion 31*c* fitted to a guide portion 80 of a lever member 8 for raising the fixing plate 31 is integrated with the end on the side of the lever member 8 of the fixing plate 31. The tongue-like protruded portion 31*c* is protruded from one side wall 2*b* of the body frame 2. The tongue-like protruded portion 31*c* is bent on the reverse side to the side on which the thermal head 30 is fixed and is further provided with a portion for contact for regulating the turning of the lever member 8.

The platen roller 4 is respectively attached to the both side walls 2*a* and 2*b* of the body frame 2 via platen bearings 41*a* and 41*b* so that the platen roller can be rotated freely. As shown in FIGS. 1 and 4, the torque of the rotation shaft 50 of the driving motor 5 is transmitted to a gear 9 fixed at one end of the platen shaft 40 of the platen roller 4 via gears 10, 11 and 12. The driving motor 5 is connected to a circuit board not shown via a lead wire 51 and a connector 52.

The lever member 8 for switching between pressure upon or release from the platen roller 4 by the thermal head 30 is attached to the other end of the platen roller 4 so that the lever member can be turned freely. The lever member 8 is made of resin such as polycarbonate and the guide portion 80 is formed in the vicinity of the center of the turning.

As shown in FIGS. 2 and 5, the guide portion 80 is formed approximately in a circular arc and is provided with a guide face 80*a* which extends from the center of the turning toward a grip 81 of the lever member 8. As shown in FIG. 5, slight clearance is formed between the guide face 80*a* of the guide portion 80 and the protruded portion 31*c* of the fixing plate 31 in a state in which the lever member 8 is pushed down. A concave portion 80*b* for fitting with the protruded portion 31*c* of the fixing plate 31 is formed at the end on the side of the grip 81 of the guide portion 80.

As shown in FIGS. 2 and 3, the paper guide 21 for guiding paper S extended from thermal recording paper rolled cylindrically to a printing position in which the thermal head 30 and the platen roller 4 come in contact is formed on the rear side of the bottom 2*c* of the body frame 2 with a part of the bottom 2*c* of the body frame 2 bent.

An introducing portion 21*a* along the shape of the platen roller 4 is formed by curving the paper guide 21 on the side of the platen roller 4. In this case, the end 21*c* of the introducing portion 21*a* enters the vicinity of a part in which the thermal head 30 and the platen roller 4 come in contact, that is, the vicinity of the printing position.

As shown in FIG. 1, grooves 24 and 25 are respectively formed on both sides at the end on the rear side of the paper guide 21 and a bend-raise portion 21*b* is formed in a part between these grooves 24 and 25 so that the bend-raise portion is protruded on the side of the platen roller 4. The bend-raise portion 21*b* is extended approximately in parallel with the platen roller 4, that is, in the direction of the width of paper S and is formed by bending for example so that the section is approximately in the shape of a mountain.

Referring to FIG. 2, the paper guide 21 is provided with an introducing portion 21*a* and a bend-raise portion 21*b*. The bend-raise portion 21*b* is subjected, for instance, to a drawing process, so that the paper guide 21 is slightly raised relative to the bottom 2*c*. That is, the paper guide 21 is provided with a step h relative to the bottom 2*c* so as to approach the platen roller 4.

As shown in FIG. 2, the top of the bend-raise portion 21*b* is formed so that the top is approximately as high as the lower part of the platen roller 4.

In this embodiment constituted as described above, when paper S is installed, the grip 81 of the lever member 8 is grasped by an operators fingers and raised. As a result, the guide face 80*a* of the guide portion 80 of the lever member 8 and the protruded portion 31*c* of the fixing plate 31 come in contact, the fixing plate 31 is raised as the lever member 8 is turned and pressure upon the platen roller 4 by the thermal head 30 is released. When the lever member 8 is further raised, the protruded portion 31*c* of the fixing plate 31 is fitted to the concave portion 80*b* of the guide portion 80 of the lever member 8 and as shown in FIG. 3, the lever member 8 is fitted with the grip 81 of the lever member 8 standing relative to the bottom 2*c* of the body frame 2. In this state, the end of paper S is inserted between the platen roller 4 and the introducing portion 21*a* of the paper guide 21 from the rear side of the paper guide 21.

If paper S is printed, the grip 81 of the lever member 8 is grasped and pushed down on the rear side. As a result, the fitting between the protruded portion 31*c* of the fixing plate 31 and the concave portion 80*b* of the guide portion 80 of the lever member 8 is released and as shown in FIG. 2, the fixing plate 31 is pressed upon paper S on the platen roller 4 by the pressure of the torsion coil spring 7. In this state, the thermal head 30 is driven, the platen roller 4 is rotated to carry paper S and predetermined printing is executed on the paper S.

According to this embodiment constituted as described above of the present invention, as the paper guide 21 provided with the introducing portion 21*a* for guiding paper S in a direction in which the paper S is wound on the platen roller 4 is integrated with the metallic body frame 2, static electricity is discharged via the body frame even if the paper S is electrified and the paper guide 21 is never electrified. As a result, as no spark is generated between the end 21*c* of the introducing portion 21*a* and the thermal head 30 and the end of the introducing portion can be arranged extremely near the platen roller 4, paper S can be readily and smoothly inserted.

In the case of this embodiment, as paper S and the bend-raise portion 21*b* of the paper guide 21 are always in contact when the paper S is printed, static electricity generated on the paper S is released via the bend-raise portion 21*b* and the paper S is never electrified. As a result, any bad effect upon the thermal head 30 by static electricity can be prevented.

Further, as the area in which paper S and the paper guide 21 are in contact is small because the paper is in contact with only the bend-raise portion 21*b*, a running load between the paper S and the paper guide 21 can be reduced if the paper S is wet. In addition, as an angle at which paper S is wound on the platen roller 4 is increased by the bend-raise portion 21*b* and ability in feeding paper is enhanced, high quality printing by the smooth running of the paper S is enabled.

Furthermore, as the paper guide 21 is provided with a step h relative to the bottom 2*c* of the body frame 2 so that clearance between the paper guide and the platen roller 4 is reduced, the introducing portion 21*a* in a shape along the platen roller 4 and the bend-raise portion 21*b* formed so that it is high as desired can be readily obtained without increasing a size of the paper guide 21 and hereby, the paper guide 21 high in rigidity and precision can be obtained.

Moreover, in the case of this embodiment, as plastic material is not used for the material of the paper guide 21, the paper guide can be thinned, and the thermal printer can be miniaturized.

Also as the paper guide 21 is integrated with the body frame 2, the number of parts is reduced and the cost can be reduced.

In addition, in this embodiment, as the thermal head 30 can be separated from the platen roller 4 by raising the lever member 8, an interval between the thermal head 30 and the platen roller 4 can be increased, and the platen roller 4 can be readily cleaned.

The present invention is not limited to the above embodiment and various variation is allowed.

For example, the shape, the thickness and others of the introducing portion and the bend-raise portion respectively formed in the paper guide are not limited to those in the above embodiment, design can be varied within the scope of the present invention and the shape, the material and others of the body frame may be also varied suitably.

APPLICABILITY TO INDUSTRY

As described above, the thermal printer according to the present invention is useful for a printer for a portable electronic device such as a receipt issuing machine and is particularly suitable for using as a small-sized line thermal printer.

What is claimed is:

1. A thermal printer comprising:

a thermal head and a platen roller, both for holding recording paper in a printing position therebetween, a metallic sheet defining a metallic body frame for supporting at least one of said thermal head and said platen roller, the metallic sheet comprising a bent portion defining a metallic paper guide in the vicinity of said printing position, for guiding said recording paper to said printing position.

2. A thermal printer according to claim 1, wherein:

said paper guide is formed as a single inseparable unit with said body frame in a position in which said recording paper is inserted; and said paper guide is provided with a bend-raise portion extended approximately in the direction of the width of said recording paper, bent upward and on which said recording paper is slid.

3. A thermal printer according to claim 2, wherein: said bend-raise portion is formed as a single inseparable unit at a part of the paper guide where the roller paper (s) is inserted.

4. A thermal printer according to claim 1, wherein said thermal head is disposed on a bottom part of said body frame for printing a paper;

said paper is urged against said thermal head by said platen roller and said roll paper is urged against said platen roller by said thermal head.

5. A thermal printer according to claim 1, further comprising:

a spring urging the thermal head toward the platen roller.

6. A thermal printer comprising:

a thermal head and a platen roller, both for holding recording paper in a printing position therebetween, a metallic sheet defining a metallic body frame for supporting at least one of said thermal head and said platen roller, the metallic sheet comprising a bent portion defining a metallic paper guide in the vicinity of said printing position, for guiding said recording paper to said printing position, said paper guide being provided with a step relative to the bottom of said body frame at both ends in the direction of the width of said recording paper so as to approach said platen roller.

7. A thermal printer comprising:

a thermal head and a platen roller, both for holding recording paper in a printing position therebetween, a metallic sheet defining a metallic body frame for supporting at least one of said thermal head and said platen roller, the metallic sheet comprising a bent portion defining a metallic paper guide in the vicinity of said printing position, for guiding said recording paper to said printing position, said paper guide is formed as a single inseparable unit with said body frame in a position in which said recording paper is inserted;

said paper guide is provided with a bend-raise portion extended approximately in the direction of the width of said recording paper, bent upward and on which said recording paper is slid; and said paper guide is provided with a step relative to the bottom of said body frame at both ends in the direction of the width of said recording paper so as to approach said platen roller.

8. A thermal printer comprising a sheet defining a body frame for supporting at least one thermal head and a platen roller for holding recording paper in a printing position between them, the sheet comprising a bent portion defining a paper guide for guiding said recording paper to said printing position, wherein:

both of said body frame and said paper guide are electrically conductive.

9. A thermal printer comprising:

a thermal head;

a platen roller contactable with the thermal head, and an electrically conductive sheet defining a body frame supporting at least one of the thermal head and the platen roller, the electrically conductive sheet comprising a bent portion defining an integral, inseparable paper guide that is electrically conductive and that extends to the vicinity of a position where the platen roller is contactable with the thermal head.

10. A thermal printer according to claim 9, wherein the body frame has a bent-raise portion that is bent upward from a bottom of the body frame, and that is elongated along the platen roller.

11. A thermal printer according to claim 10, wherein a minimal distance between the platen roller and the bottom of the body frame is substantially equal to a maximum distance between the bent-raise portion and the bottom of the body frame.

12. A thermal printer according to claim 9, wherein the paper guide is raised upward from a bottom of the body frame by a step.

13. A thermal printer according to claim 9, further comprising:

a spring by which the thermal head and the platen roller are urged against each other.

14. A thermal printer according to claim 9, further comprising:

a spring urging the thermal head toward the platen roller.

15. A thermal printer according to claim 9, wherein the paper guide is partially curved.

* * * * *